United States Patent [19]

Altemark et al.

[11] Patent Number: 4,859,171

[45] Date of Patent: Aug. 22, 1989

[54] METHOD AND APPARATUS OF OPERATING PRE-MIXED BURNERS

[75] Inventors: Detlef Altemark, Dorsten; Robert Hess, Essen, both of Fed. Rep. of Germany

[73] Assignee: Ruhrgas Aktiengesellschaft, Essen, Fed. Rep. of Germany

[21] Appl. No.: 91,197

[22] Filed: Aug. 31, 1987

[30] Foreign Application Priority Data

Sep. 4, 1986 [DE] Fed. Rep. of Germany ..... 3630177

[51] Int. Cl.[4] ..... F23N 1/02

[52] U.S. Cl. ..... 431/12

[58] Field of Search ..... 431/12, 18, 76, 80, 431/90, 20, 89, 78, 79

[56] References Cited

U.S. PATENT DOCUMENTS

| | | | |
|---|---|---|---|
| 2,324,821 | 7/1943 | Campbell | 431/12 |
| 2,352,143 | 6/1944 | Wills | 431/12 |
| 3,768,955 | 10/1973 | McLaughlin | 431/12 |
| 3,988,104 | 10/1976 | Barber | 431/12 |
| 4,477,245 | 10/1984 | Giachino et al. | 431/12 |
| 4,588,372 | 5/1986 | Torborg | 431/12 |
| 4,645,450 | 2/1987 | West | 431/12 |

FOREIGN PATENT DOCUMENTS

| | | | |
|---|---|---|---|
| 1495015 | 2/1974 | United Kingdom | 431/12 |

OTHER PUBLICATIONS

EP-A-0 021 035 (Ruhrgas), NL-A-8 403 840 (TNO).
Patent Abstracts of Japan, JP-A-60 69 428, (Babcock), Hitachi K.K.).
Patent Abstracts of Japan, JP-A-60 16 218, (Rinnai K.K.).
Patent Abstracts of Japan, JP-A-58 99 613, Mitsubishi Jukogyo K.K.).
Patent Abstracts of Japan, JP-A-58 33 025, Matsushita Denki Sangyo K.K.).

*Primary Examiner*—James C. Yeung
*Attorney, Agent, or Firm*—Spensley, Horn Jubas & Lubitz

[57] ABSTRACT

A pre-mixed burner fired at or above atmospheric pressure by a gaseous fuel or a fuel that is liquid at ambient temperature or a liquid fuel completely evaporated prior to combustion comprises a mixer wherein the fuel, combustion air and a cooling fluid are blended prior to combustion downstream of a burner plate. The combustion forms a flame at or near the limit of flame stability. The ionization current which is a characteristic property of each flame is measured by two electrodes which transmit signals to a controller controlling the flow of at least one of the fluids flowing to the mixer by corresponding valve actuation for safe burner operation at or near the limit of flame stability.

15 Claims, 3 Drawing Sheets

METHOD AND APPARATUS OF OPERATING PRE-MIXED BURNERS

BACKGROUND OF THE INVENTION

1. Field of the Invention

The present invention relates to a method of operating a pre-mixed burner at or above atmospheric pressure by blending a gaseous or liquid fuel and combustion air preferably together with a cooling fluid in a mixer and reacting the mixture so obtained in a downstream combustion chamber where a flame is formed, the temperature and thence the speed of said flame being relatively low under the given conditions.

2. Prior Art

It is well-known that the products of the combustion of gaseous or liquid fuel contain oxides of nitrogen (hereinafter referred to as "$NO_x$") which are undesirable, both because they contribute to air pollution and because they may affect a product or a charge which comes into contact with said products of combustion. As prior work has shown, said $NO_x$ is mainly formed by reactions of nitrogen compounds contained in the fuel and the reaction at high temperature of molecular nitrogen which is a constituent of the combustion air and may also be contained in certain fuels such as natural gas. The latter thermal formation of $NO_x$ is a reaction which proceeds at a particularly high rate above a very high limit temperature which is, for example, approximately 1,600° C. for the combustion of natural gas.

European Patent Application No. EP-B00 21 035 reveals a method which allows the complete combustion of gaseous or vapourized fuel at a relatively low temperature, thereby producing a flue gas containing extremely little $NO_x$ and provides for flame stability over a very wide heat output range and more particularly at very high heat outputs. For such a very low $NO_x$ output and such high flame stability, said method proposes the utilization of a cooling fluid which reduces the flame temperature and nonetheless permits stable combustion, the flame formed during the combustion of the mixture being of a particular geometry and being shielded from extraneous gaseous fluids and extraneous temperature effects until the complete burnout of the mixture.

THE INVENTION

It is the object of the present invention to provide for a method of operating the low-$NO_x$ pre-mixed burner known from the European Patent Application No. EP-B-00 21 035 at or relatively close to the limit of flame stability which will allow complete burnout and will, under no circumstances, allow combustion to become unstable.

To provide for such a method, the present invention teaches that under the homogenous combustion conditions described in the European Patent Application No. EP-B-00 21 035 the properties of the flame provide the best and the most rapid information on the combustion process and more particularly on the desired process of low-polluting combustion and constitute thence the most suitable control variables.

The present invention hence proposes the measurement or supervision of at least one property of the flame characteristic of the closeness of said flame to the limit of flame stability and the exploitation of said property as a control variable for controlling the rate of flow of at least one of the fluids flowing to the mixer of the pre-mixed burner for combustion relatively close to said limit of flame stability. The application of said pre-mixed burner will determine whether the fuel, the combustion air or the cooling fluid flow rate will be so controlled. As flame properties provide the best and the most rapid information on the closeness of the flame to the limit of flame stability, the use of such a property as a variable for controlling the ratio in which the fuel, the combustion air and the cooling fluid are blended in the mixer provides for a highly responsive combustion control system.

It is an important advantage of the present invention that the method proposed herein makes the operation of the burner independent of (a) burner load (b) fuel composition, adding an air ratio controller where necessary (c) the temperature and the pressures of the fluids flowing to the burner (as for example fuel gas, air or cooling fluid) and (d) the pressure in the combustion chamber.

Flame properties characteristics of the closeness of a flame to the limit of flame stability which may be employed as control variables in accordance with the teachings of the present invention include the ionization current, pressure variation, temperature and ultraviolet radiation.

The ionization current is the flame property preferred for use as a control variable as said ionization current varies without delay in response to changes in a flame. Moreover, said ionization current can be measured quickly and by simple techniques, both at individual points and over a given span. It may be picked up from an ionization type flame failure device if the burner is fitted with such a device or measured by at least one pair of electrodes with a part of the burner serving as the cathode, if desired. It is also possible to arrange a number of electrodes or pairs of electrodes in the combustion chamber for the measurement of said ionization current.

According to the present invention, the fuel/air or cooling fluid ratio may be modulated as the burner operates close to the flame stability limit to improve the signal characteristic of said flame stability limit further.

If the burner does not combat an excess air mixture but uses a fluid other than air such as flue gas for cooling, a cascaded air ratio control may be provided in accordance with the teachings of the present invention to optimize the operation of the burner further.

BRIEF DESCRIPTION OF THE DRAWINGS

A preferred embodiment of the present invention employing the ionization current as a control variable to control a pre-mixed burner at or near the limit of flame stability by controlling at least one of the fluids blended in the mixer of said burner will now be described by way of example with reference to the accompanying drawing in which.

DETAILED DESCRIPTION OF THE INVENTION

Figure 1:
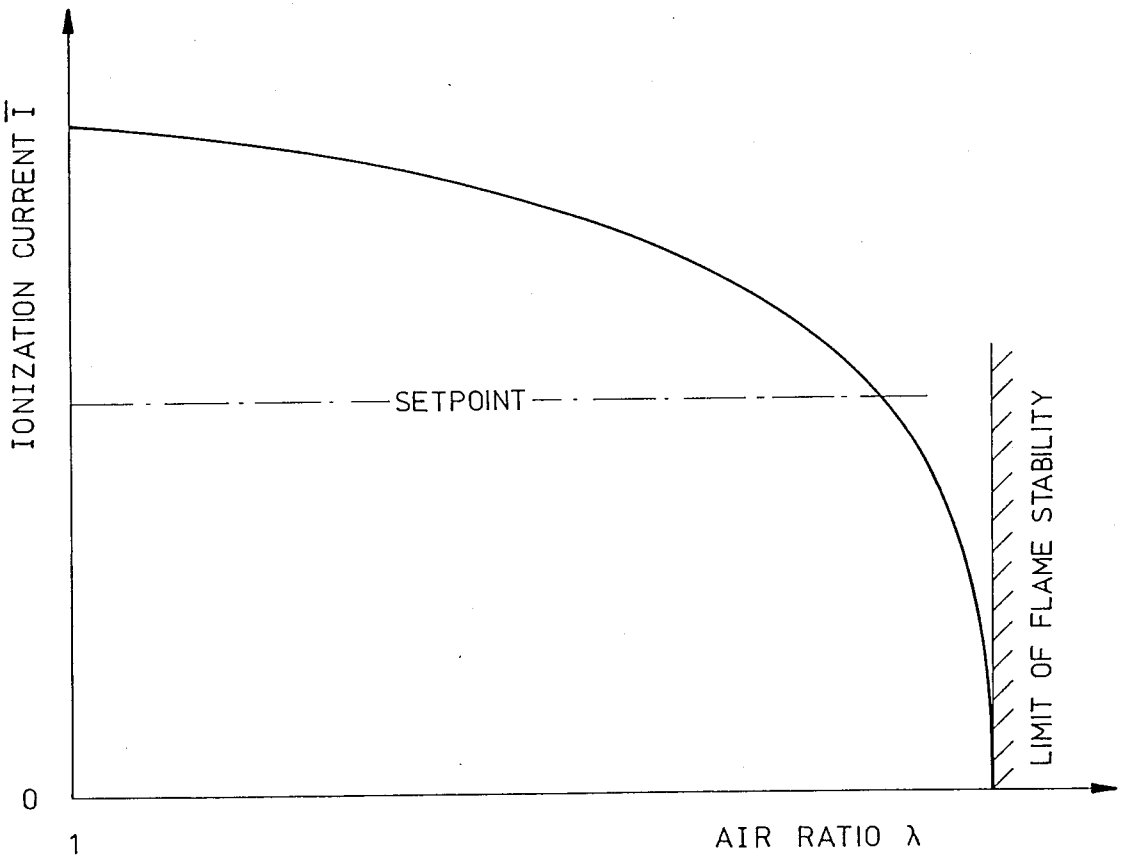
FIG. 1 shows the correlation between the mean ionization current and the air ratio.

Referring first to FIG. 1, the graph shows the mean of the ionization current I measured in the flame of a pre-mixed fuel-lean burner as a function of the air ratio λ, the characteristic fluctuations of said ionization current having been suppressed by appropriate attenuation methods. Said mean I of said ionization current decreases as said air ratio declines, the slope of said decrease being less steep for high air ratios and becoming steeper as low air ratios and the limit of flame stability are being approached. As the flame is extinguished at the limit of flame stability, no ionization current flows. In vicinity of said limit of flame stability, the rate of change of said mean of said ionization current is relatively high for a low rate of change of the air ratio λ, said means ionization current thence being an especially suitable variable for the control of a burner operating relatively close to said limit of flame stability. The set point seen in FIG. 1 is merely depicted as an example and any person versed in the air will appreicate that different set points may be used.

Figure 2:
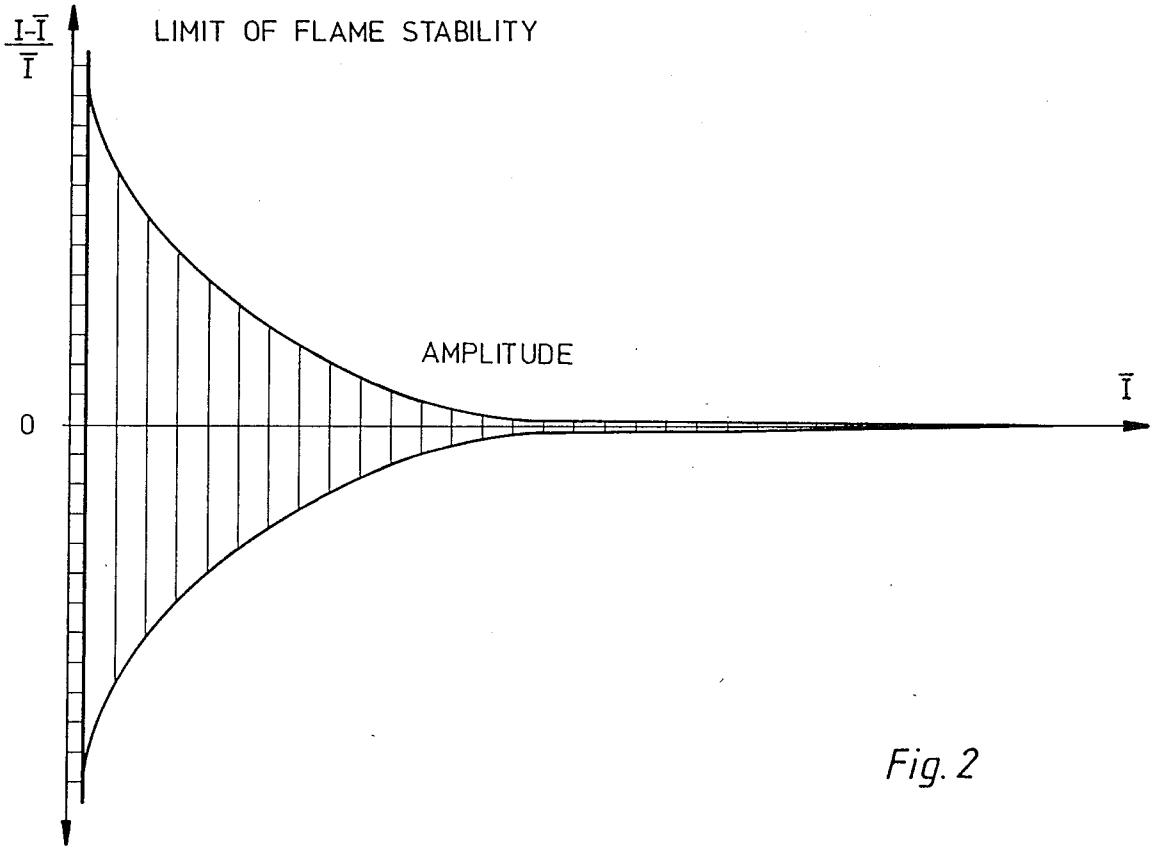
FIG. 2 shows the amplitude of the ionization current variations.

Referring now to FIG. 2, the control proposed by the present invention may respond to the amplitude of the ionization current fluctuations in lieu of the mean of said ionization current, because the amplitude of the ionization current variations around the mean ionization current increases as the limit of flame stability is approached, said amplitude therefore also being a suitable control variable for a burner operated close to the limit of flame stability. If said amplitude is so used as a control variable, the ionization current signal is thus not attenuated. As the frequency spectrum of the ionization current variations also changes in a fashion similar to the mode of change of the amplitude described hereinbefore as the limit of flame stability is approached, said frequency spectrum may also be employed as a control variable.

Figure 3:
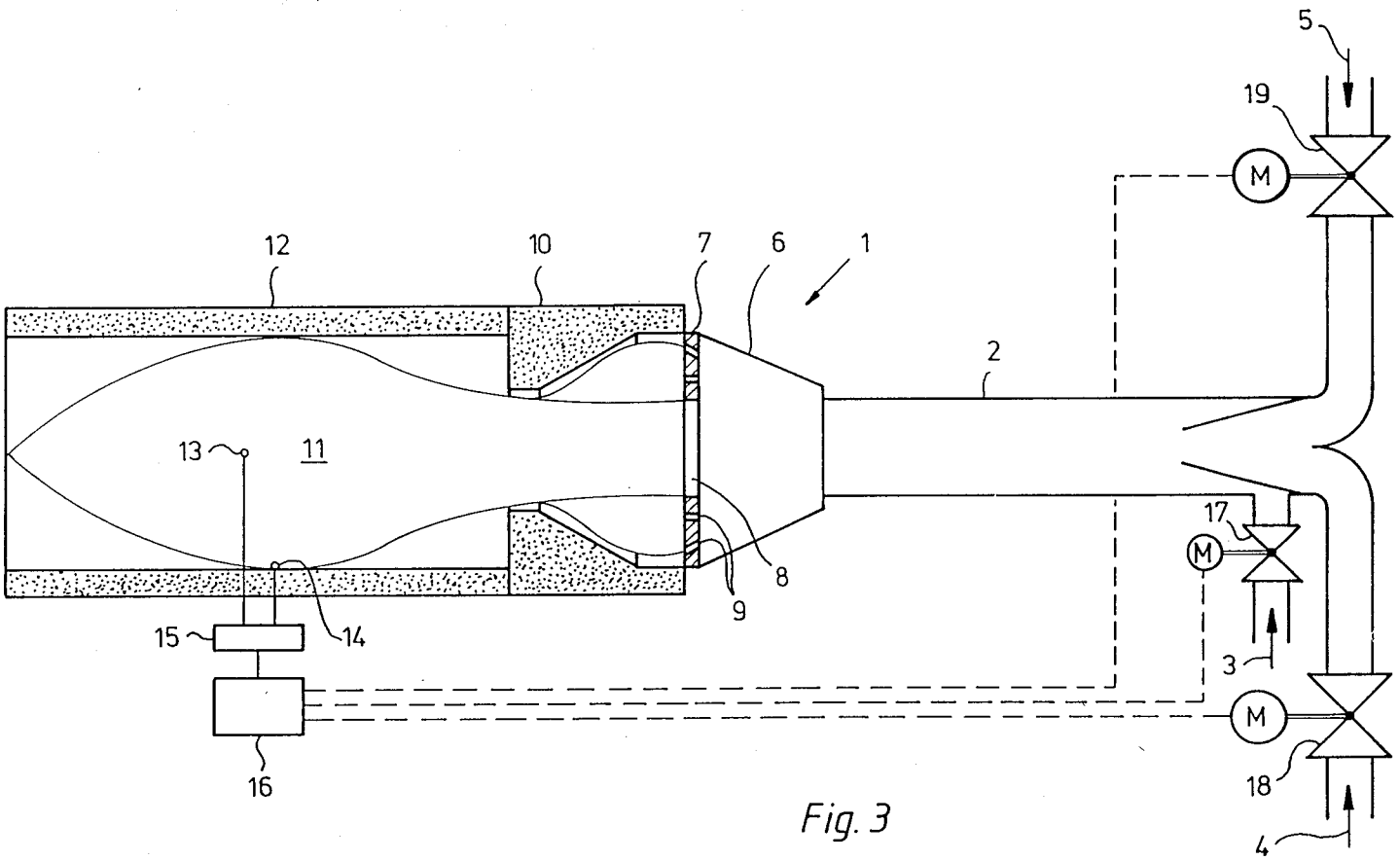
FIG. 3 is a schematic of an apparatus for the application of the method proposed by the present invention.

Referring now to FIG. 3, the drawing shows a schematic of an apparatus according to the present invention for the application of the method proposed hereinbefore. A pre-mixed burner 1 known from European Patent Application No. EP-B-00 21 035 comprises a mixer 2 for blending fuel 3, combustion air 4 and cooling fluid 5 to obtain a homogenous gas mixture, a diverging burner head 6 and a burner plate 7 provided with a large main flame bore 8 and small bores 9 arranged concentrically around said main bore 8. A combustion chamber comprising a burner mouth 10 and a jacket 12 shielding the flame 11 and connected with said burner mouth 10 is situated downstream of said burner plate 7. An electrode 13 is arranged in said flame 11 forming an electrode pair together with electrode 14 arranged by way of example on the burner wall, said pair of electrodes being used to measure the ionization current of flame 11.

Said electrodes 13 and 14 are coupled with a transducer 15 producing an output signal which is transmitted to a controller 16 which converts said input signal to control control elements 17, 18 and 19 controlling the flow rates of fluids 3, 4 and 5 in a manner which will allow an operation of the burner 1 close to the limit of flame stability. It is contemplated that many changes and modifications may be made by one ordinarily skilled in the art to the apparatus described by way of example hereinabove without departing from the spirit and the scope of the present invention which proposes a method for the quiet, reliable and low-polluting combustion of a fuel/air mixture preferably together with a cooling fluid over a wide range of heat outputs, the flame always being kept close to the limit of flame stability.

What is claimed:

1. A method of operating a pre-mixed burner at a pressure equal to at least atmospheric pressure, said method comprising the steps of:

blending a fluid fuel, combustion air, and cooling fluid to produce a fuel lean combustible mixture;

combusting said fuel lean combustible mixture in a downstream combustion chamber, thereby forming at least one flame, said flame having a limit of flame stability at an air/fuel ratio greater than one;

measuring a flame property that is characteristic of the proximity of the flame to said limit of flame stability;

deriving a control signal from said measured flame property; and controlling the rate of flow of at least one of the fluids contained in said combustible mixture in response to said control signal, whereby said rate of flow is controlled such that the combustion is performed near said limit of flame stability.

2. A method according to claim 1 wherein said measured flame property is the ionization current of the flame.

3. A method according to claim 1 wherein the flame property is the ionization current of the flame.

4. A method according to claim 3, wherein the ionization current of the flame defines a mean ionization current and further comprising the steps of:

measuring the mean of the ionization current of the flame, and deriving the control signal from the measured mean of the ionization current of the flame.

5. A method according to claim 3, wherein the ionization current of the flame undergoes variations and further comprising the steps of:

determining the amplitude of the variations of the ionization current of the flame, and deriving the control signal from the determined amplitude of the variations of the ionization current of the flame.

6. A method according to claim 3, wherein the ionization current of the flame undergoes variations and further comprising the steps of determining the frequency spectrum of the variations of the ionization current of the flame and deriving the control signal from the determined frequency spectrum of the variations of the ionization current of the flame.

7. A method according to claim 3, wherein said ionization current is detected from a flame detection device.

8. A method according to claim 3, wherein said ionization current is measured by a pair of electrodes arranged in said combustion chamber.

9. A method according to claim 3, wherein said ionization current is measured by a plurality of electrodes arranged in said combustion chamber.

10. In a pre-mixed burner system comprising a mixer for blending fluids to provide a combustible mixture, a combustion chamber for combusting the combustible mixture and forming a flame, the flame having a flame property characteristic of the proximity of the flame to the limit of flame stability, sensor means for measuring the flame property, control means for providing a control signal in response to the measured flame property, and actuating means for controlling the fluids supplied to the mixer, a method of combusting the combustible mixture at a reduced $NO_x$ output, the method comprising the steps of:

supplying fluid fuel, combustion air and cooling fluid to the mixer at a selected relative rate of flow;

blending the fluid fuel, combustion air and cooling fluid in the mixer to obtain a homogenous fluid mixture;

selecting the relative rate of flow so as to produce a combustible mixture in the mixer, the combustible mixer having an air/fuel ratio greater than one, thereby enabling a complete burnout of the fuel;

combusting the combustible mixure in the combustion chamber to thereby form a flame, the flame having a limit of flame stability spaced from the stoichiometric air/fuel ratio;

measuring the flame property, deriving a control signal from the measured flame property, and controlling the rate of flow in response to the control signal, whereby the combustion is performed near the limit of flame stability without extinguishing the flame.

11. A method according to claim 10, wherein the flame property comprises the variation in the pressure of said flame.

12. A method according to claim 10, wherein the flame property comprises the temperature of said flame.

13. A method according to claim 10, wherein the flame property comprises the ultraviolet radiation of said flame.

14. A method according to claim 10, wherein the relative rate of flow is variable and further comprising the steps of:

measuring variations in the relative rate of flow, deriving a control signal from the measured variations in the relative rate of flow, and controlling the rate of flow of at least one of the fluid fuel, the combustion air and the cooling fluid in response to the control signal derived from the measured variations in the relative rate of flow.

15. A method according to claim 10 further comprising the step of modulating the ratio at which said fuel, said combustion air and said cooling fluid are blended.

* * * * *